US008362375B2

(12) United States Patent
Wildman

(10) Patent No.: US 8,362,375 B2
(45) Date of Patent: Jan. 29, 2013

(54) PRESSURE DIFFERENTIAL SWITCH

(75) Inventor: Craig R. Wildman, Charlotte, NC (US)

(73) Assignee: UniControl, Inc., Parma, OH (US)

( * ) Notice: Subject to any disclaimer, the term of this patent is extended or adjusted under 35 U.S.C. 154(b) by 443 days.

(21) Appl. No.: 12/522,879

(22) PCT Filed: Jan. 11, 2008

(86) PCT No.: PCT/US2008/000411

§ 371 (c)(1),
(2), (4) Date: May 14, 2010

(87) PCT Pub. No.: WO2008/086038

PCT Pub. Date: Jul. 17, 2008

(65) Prior Publication Data

US 2010/0230269 A1 Sep. 16, 2010

Related U.S. Application Data

(60) Provisional application No. 60/879,856, filed on Jan. 10, 2007.

(51) Int. Cl.
*H01H 5/22* (2006.01)
*H01H 35/34* (2006.01)

(52) U.S. Cl. ..... 200/83 R; 200/83 P; 200/459; 200/461

(58) Field of Classification Search ..... 200/16 R–16, 200/405–408, 449–461, 81 R, 83 R–83 SA, 200/520, 533–535, 239, 244–251
See application file for complete search history.

(56) References Cited

U.S. PATENT DOCUMENTS 1,231,561 A 7/1917 Briggs
1,960,020 A 5/1934 McGall
2,182,856 A 12/1939 Riche
2,450,961 A 10/1948 Heymann et al.
2,500,457 A 3/1950 Hess
2,743,331 A * 4/1956 Lauder et al. ..... 200/461
3,056,866 A 10/1962 Karleen
3,244,848 A * 4/1966 Chapin et al. ..... 200/307
3,270,156 A * 8/1966 Stewart ..... 200/408
3,527,909 A 9/1970 Torre
3,553,403 A 1/1971 Porwancher
3,773,991 A 11/1973 Krieger et al.
3,878,347 A * 4/1975 Roeser ..... 200/462
3,967,370 A 7/1976 Griffin et al.
4,104,495 A * 8/1978 Jones et al. ..... 200/83 P
(Continued)

OTHER PUBLICATIONS

Office Action; dated May 14, 2012; issued by the State Intellectual Property office of the People's Republic of China for Chinese Patent Application No. 200880002094.9 (with English translation); 10 pages.

(Continued)

*Primary Examiner* — Michael Friedhofer
(74) *Attorney, Agent, or Firm* — Ulmer & Berne LLP

(57) ABSTRACT

A diaphragm-actuated pressure differential switch assembly includes a blade spring for switching an electrical circuit. The blade spring comprises a proximal end portion configured for electrically conductive attachment to an electrical terminal, a plurality of flexible tension arms extending from the proximal end portion, a pressure contact region configured to accept transmission of a physical force to bend at least one of the plurality of flexible tension arms, a distal end portion integral with the flexible tension arms, the distal end portion including an electrical contact, and a compression spring integral with the distal end portion extending generally proximally from the distal end portion, the compression spring including a first leg and a second leg. Methods of constructing and using the diaphragm-actuated pressure differential switch assembly and the blade spring are also disclosed.

33 Claims, 13 Drawing Sheets

U.S. PATENT DOCUMENTS

| | | | | |
|---|---|---|---|---|
| 4,194,103 | A | 3/1980 | Smith | |
| 4,281,229 | A | 7/1981 | Poleschuk et al. | |
| 4,410,776 | A * | 10/1983 | Stoll | 200/83 P |
| 4,605,830 | A | 8/1986 | Reid | |
| 4,914,264 | A | 4/1990 | Everett | |
| 5,001,317 | A | 3/1991 | Atkinson et al. | |
| 5,043,545 | A | 8/1991 | Yamashita et al. | |
| 5,111,010 | A | 5/1992 | Kokubu et al. | |
| 5,187,338 | A * | 2/1993 | Kaigler | 200/83 R |
| 5,198,632 | A | 3/1993 | Kaigler et al. | |
| 5,459,295 | A * | 10/1995 | Ohta et al. | 200/461 |
| 5,717,177 | A * | 2/1998 | Tsai et al. | 200/16 R |
| 5,744,770 | A | 4/1998 | Moessinger et al. | |
| 5,913,415 | A | 6/1999 | Kishi et al. | |
| 6,125,218 | A | 9/2000 | Humphrey | |
| 6,346,681 | B1 | 2/2002 | Joyce et al. | |
| 6,495,777 | B1 | 12/2002 | Chou | |
| 6,713,702 | B1 * | 3/2004 | Lee | 200/520 |
| 6,847,000 | B1 | 1/2005 | Marchini et al. | |
| 7,071,430 | B2 * | 7/2006 | Farano et al. | 200/81.4 |
| 7,078,637 | B2 | 7/2006 | Lee | |
| 7,348,509 | B2 * | 3/2008 | Severson et al. | 200/83 J |
| 7,453,049 | B2 * | 11/2008 | Ochiai et al. | 200/83 A |
| 2006/0225993 | A1 | 10/2006 | Heuthorst et al. | |
| 2007/0068782 | A1 | 3/2007 | Harper | |
| 2008/0164134 | A1 * | 7/2008 | Ochiai et al. | 200/83 P |

OTHER PUBLICATIONS

International Search Report mailed on Jun. 26, 2008 for International Application No. PCT/US2008/0004111 (1 page). The above-captioned application is a National Stage Application of International Application No. PCT/US2008/000411.

International Preliminary Report on Patentability issued on Jul. 14, 2009 for International Application No. PCT/US2008/000411, including the Written Opinion of the International Searching Authority mailed on Jun. 26, 2008 (7 pages total). The above-captioned application is a National Stage Application of International Application No. PCT/US2008/000411.

Sensing and Control, Honeywell Inc., "Micro Switch General Technical Bulletin No. 14, Applying Precision Switches" (84 pages). Admitted to be in the public domain prior to Jan. 10, 2006.

* cited by examiner

PRESSURE DIFFERENTIAL SWITCH

PRIORITY CLAIM

This application claims priority to, and the full benefit of, U.S. Provisional Patent Application No. 60/879,856 filed Jan. 10, 2007 which is incorporated by reference in its entirety.

TECHNICAL FIELD

This disclosure relates generally to the field of pressure sensing switches and more specifically to the field of diaphragm-actuated pressure sensing switches.

BACKGROUND

Some systems, such as heating, ventilation, and air conditioning systems, among others, sense differences in air or other fluid pressures to provide control or monitoring information to other components. In these systems, a pressure differential switch can be used as part of a control or monitoring system. A typical pressure differential switch includes a housing that is separated into two pressure regions by a diaphragm and some type of switch assembly. When pressure levels in each of the two pressure regions differ by an amount sufficient to activate the switch, the switch changes from a deactivated state to an activated state. When pressure levels in each of the two pressure regions change such that any difference in levels in below that required to activate the switch, the previously activated switch will return to a deactivated state.

SUMMARY

A blade spring for switching an electrical circuit comprises a proximal end portion, a plurality of flexible tension arms, a pressure contact region, a distal end portion, and a compression spring. The proximal end portion is configured for electrically conductive attachment to an electrical terminal. The plurality of flexible tension arms extend from the proximal end portion. The pressure contact region is configured to accept transmission of a physical force to bend at least one of the plurality of flexible tension arms. The distal end portion is integral with the flexible tension arms and includes an electrical contact. The compression spring is integral with the distal end portion and extends generally proximally from the distal end portion. The compression spring includes a first leg and a second leg.

A switch assembly for sensing differences in fluid pressure comprises a blade spring, a common electrical terminal, and a normally open electrical terminal. The blade spring includes a proximal end portion, a plurality of flexible tension arms, a pressure contact region, a distal end portion, and a compression spring. The proximal end portion is configured for electrically conductive attachment to an electrical terminal. The plurality of flexible tension arms extend from the proximal end portion. The pressure contact region is configured to accept transmission of a physical force to bend at least one of the plurality of flexible tension arms. The distal end portion is integral with the flexible tension arms. The distal end portion includes an electrical contact. The compression spring is integral with, and extends generally proximally from, the distal end portion. The compression spring includes a first leg and a second leg. The common electrical terminal is electrically connected to the proximal end portion of the blade spring. The normally open electrical terminal includes a contact configured to electrically connect to the contact of the distal end portion of the blade spring.

A method for constructing a blade spring comprises forming an elongated piece of flexible electrically conductive spring material and forming a plurality of tension arms from the elongated piece. The method further includes integrally forming a compression portion from the elongated piece.

A blade spring for switching an electrical circuit comprises a proximal end portion, a plurality of flexible tension arms, means for accepting transmission of a physical force to bend at least one of the plurality of flexible tension arms, a distal end portion, and means for applying tension to the flexible tension arms integral with the distal end portion. The proximal end portion is configured for electrically conductive attachment to an electrical terminal. The plurality of flexible tension arms extend from the proximal end portion. The distal end portion is integral with the flexible tension arms and includes an electrical contact.

A method for signaling differences in fluid pressure comprises moving a diaphragm assembly at least partially in response to a fluid pressure differential across the diaphragm assembly. The method also includes moving into an electrically conductive position with a normally open terminal an electrical contact carried by a blade spring. The blade spring includes a proximal end portion, a plurality of flexible tension arms, a pressure contact region, a distal end portion, and an integral compression spring. The proximal end portion is configured for electrically conductive attachment to an electrical terminal. The plurality of flexible tension arms extend from the proximal end portion. The pressure contact region is configured to accept transmission of a physical force to bend at least one of the plurality of flexible tension arms. The distal end portion is integral with the flexible tension arms and includes the electrical contact. The compression spring extends generally proximally from, and integral with, the distal end portion. The compression spring includes a first leg and a second leg.

A method for constructing a blade spring comprises forming an elongated piece of flexible electrically conductive spring material and forming a plurality of tension arms from the elongated piece. The method further includes integrally forming a compression portion from the elongated piece.

A blade spring for switching an electrical circuit comprises a proximal end portion, a plurality of flexible tension arms, means for accepting transmission of a physical force to bend at least one of the plurality of flexible tension arms, a distal end portion, and means for applying tension to the flexible tension arms integral with the distal end portion. The proximal end portion is configured for electrically conductive attachment to an electrical terminal. The plurality of flexible tension arms extend from the proximal end portion. The distal end portion is integral with the flexible tension arms and includes an electrical contact.

A method for signaling differences in fluid pressure comprises moving a diaphragm assembly at least partially in response to a fluid pressure differential across the diaphragm assembly. The method also includes moving into an electrically conductive position with a normally open terminal an electrical contact carried by a blade spring. The blade spring includes a proximal end portion, a plurality of flexible tension arms, a pressure contact region, a distal end portion, and an integral compression spring. The proximal end portion is configured for electrically conductive attachment to an electrical terminal. The plurality of flexible tension arms extend from the proximal end portion. The pressure contact region is configured to accept transmission of a physical force to bend at least one of the plurality of flexible tension arms. The distal end portion is integral with the flexible tension arms and includes the electrical contact. The compression spring extends generally proximally from, and integral with, the distal end portion. The compression spring includes a first leg and a second leg.

A method for signaling differences in fluid pressure comprises moving a diaphragm assembly at least partially in response to a fluid pressure differential across the diaphragm assembly. The method also includes moving away from an electrically conductive position with a normally open terminal an electrical contact carried by a blade spring. The blade spring includes a proximal end portion a plurality of flexible tension arms, a pressure contact region, a distal end portion, and an integral compression spring. The proximal end portion is configured for electrically conductive attachment to an electrical terminal. The plurality of flexible tension arms extends from the proximal end portion. The pressure contact region is configured to accept transmission of a physical force to bend at least one of the plurality of flexible tension arms. The distal end portion is integral with the flexible tension arms and includes the electrical contact. The compression spring extends generally proximally from, and integral with, the distal end portion. The compression spring includes a first leg and a second leg.

A method for signaling differences in fluid pressure comprises moving a diaphragm assembly at least partially in response to a fluid pressure differential across the diaphragm assembly. The method also includes moving into an electrically conductive position with a normally closed terminal an electrical contact carried by a blade spring. The blade spring includes a proximal end portion, a plurality of flexible tension arms, a pressure contact region, a distal end portion, and an integral compression spring. The proximal end portion is configured for electrically conductive attachment to an electrical terminal. The plurality of flexible tension arms extend from the proximal end portion. The pressure contact region is configured to accept transmission of a physical force to bend at least one of the plurality of flexible tension arms. The distal end portion is integral with the flexible tension arms and includes the electrical contact. The compression spring extends generally proximally from, and integral with, the distal end portion. The compression spring includes a first leg and a second leg.

A method for signaling differences in fluid pressure comprises moving a diaphragm assembly at least partially in response to a fluid pressure differential across the diaphragm assembly. The method also includes moving between an electrically conductive position with a normally open terminal and an electrically conductive position with a normally closed terminal an electrical contact carried by a blade spring. The blade spring includes a proximal end portion, a plurality of flexible tension arms, a pressure contact region, a distal end portion, and an integral compression spring. The proximal end portion is configured for electrically conductive attachment to an electrical terminal. The plurality of flexible tension arms extend from the proximal end portion. The pressure contact region is configured to accept transmission of a physical force to bend at least one of the plurality of flexible tension arms. The distal end portion is integral with the flexible tension arms and includes the electrical contact. The compression spring extends generally proximally from, and integral with, the distal end portion. The compression spring includes a first leg and a second leg.

A method for signaling a difference in fluid pressures comprises placing a diaphragm assembly within a housing. The housing and the diaphragm assembly cooperate to define a high pressure chamber and a low pressure chamber separated by the diaphragm assembly. The method also includes mounting a blade spring within the housing. The blade spring includes a proximal end portion and a distal end portion having an electrical contact and wherein mounting comprises fixing the proximal end portion of the blade spring to a first terminal. The method further includes electrically connecting the blade spring to a second terminal when a difference in fluid pressure between the high pressure chamber and the low pressure chamber is at least equal to a predetermined value.

BRIEF DESCRIPTION OF THE DRAWINGS

While the specification concludes with claims particularly pointing out and distinctly claiming the present embodiment, it is believed that the same will be better understood from the following description taken in conjunction with the accompanying drawings in which:

DETAILED DESCRIPTION

The device disclosed and described in this document, along with its operation, are described in detail with the views and examples of the included figures. Unless otherwise specified, like numbers in figures indicate references to the same or corresponding elements throughout the views of the figures. Those of ordinary skill in this art area will recognize that modifications to disclosed and described components can be made and may be desired for a specific application. In this disclosure, any identification of specific shapes is either related to a specific example presented or is merely a general description of such a shape. Identifications of specific shapes are not intended to be, and should not be construed as mandatory or limiting unless specifically designated as such.

Figure 1A:
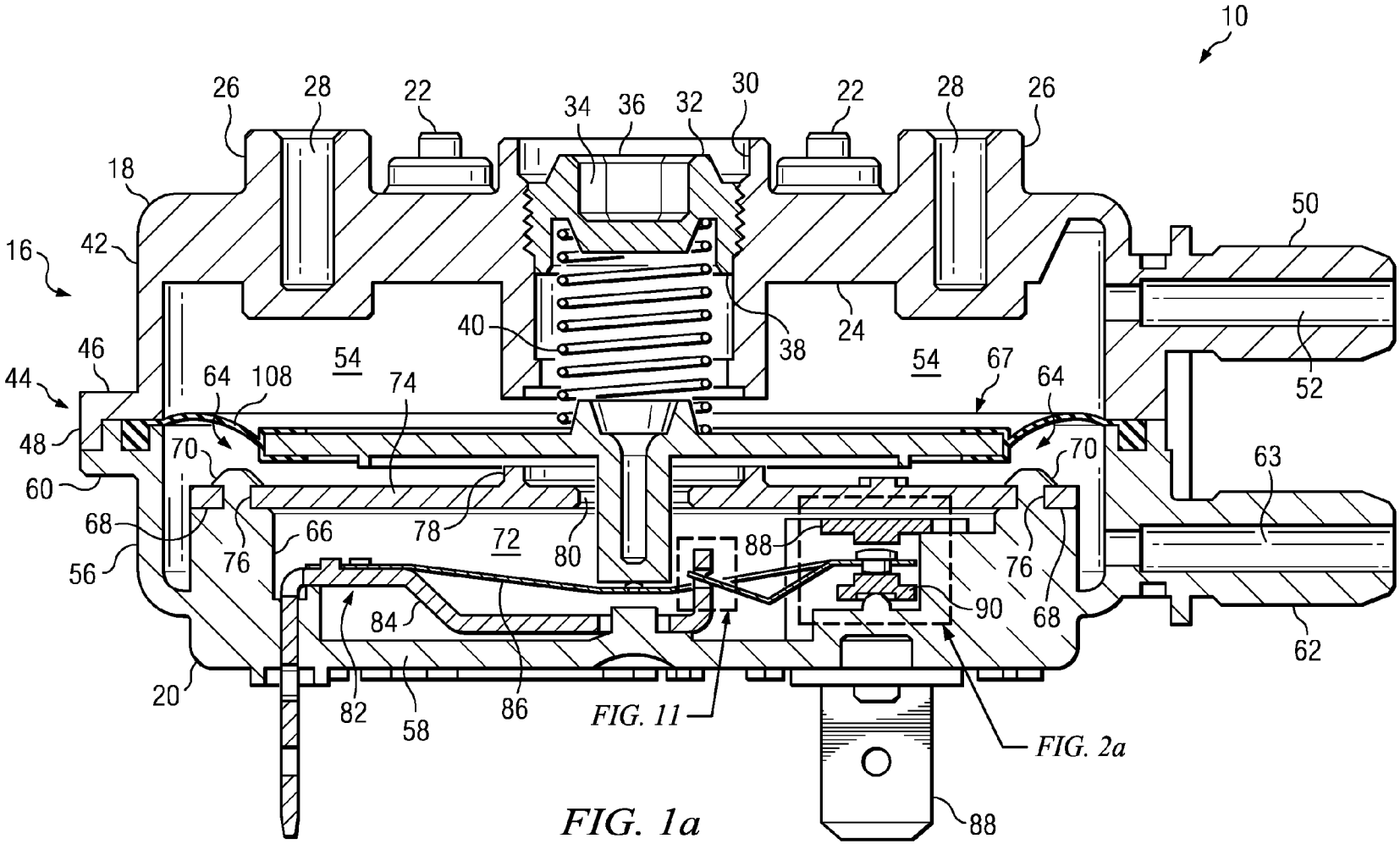
FIG. 1*a* is a cross sectional view of a pressure differential switch assembly, wherein an included diaphragm assembly is in contact with a blade spring in accordance with one embodiment.
Figure 2A:
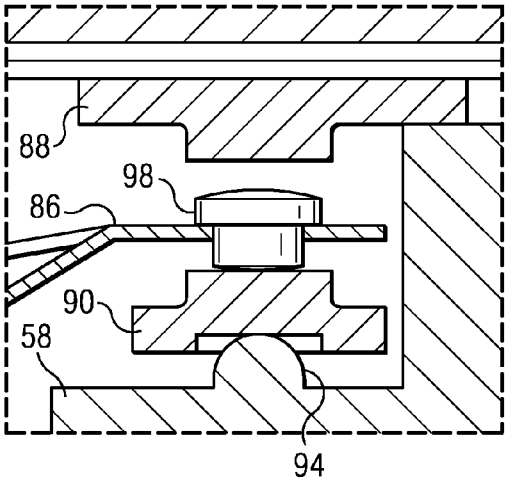
FIG. 2*a* is an enlarged view of a portion of the pressure differential switch assembly shown in FIG. 1*a;*

FIGS. 1*a* and 2*a* illustrate a pressure differential switch assembly 10 according to one embodiment. The pressure differential switch assembly 10 can be used to sense a difference in pressures between two areas of fluid pressure. Specifically, the pressure differential switch assembly 10 can be used to sense a difference in air pressure between regions of a heating, ventilation, and cooling ("HVAC") system, or to sense gauge pressure in a region of an HVAC system. Another possible application for the pressure differential switch assembly 10 can be to sense for the existence of an amount of airflow that is adequate to support combustion in a furnace. The pressure differential switch assembly 10 can also be used for applications other than HVAC. Additionally, the pressure differential switch assembly 10 can be used to sense a difference in pressures of fluids other than air, such as various other gasses, liquids, or both.

Figure 1B:
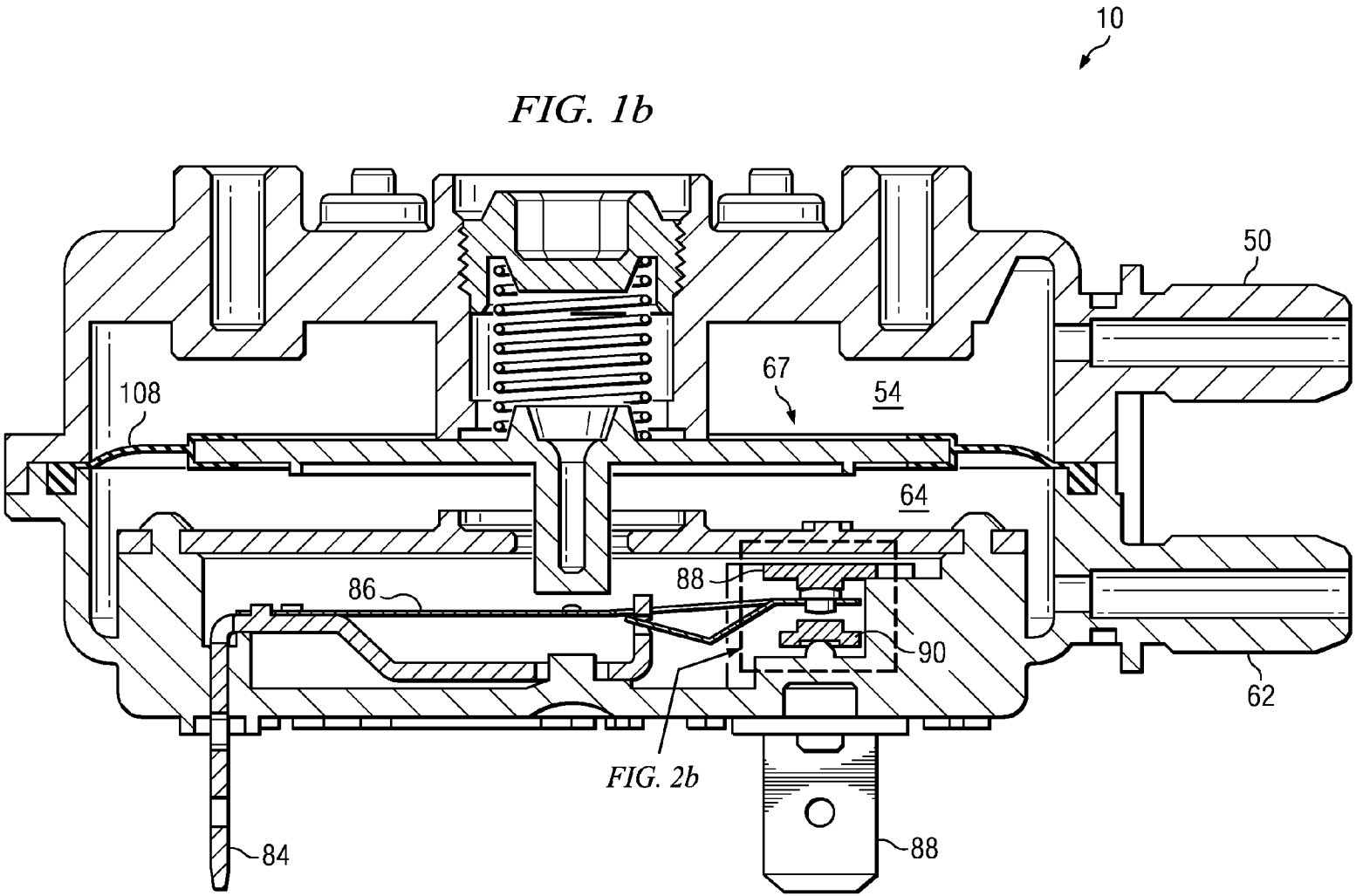
FIG. 1*b* is a cross sectional view similar to FIG. 1*a,* wherein the included diaphragm assembly is spaced from the blade spring in accordance with one embodiment.
Figure 1C:
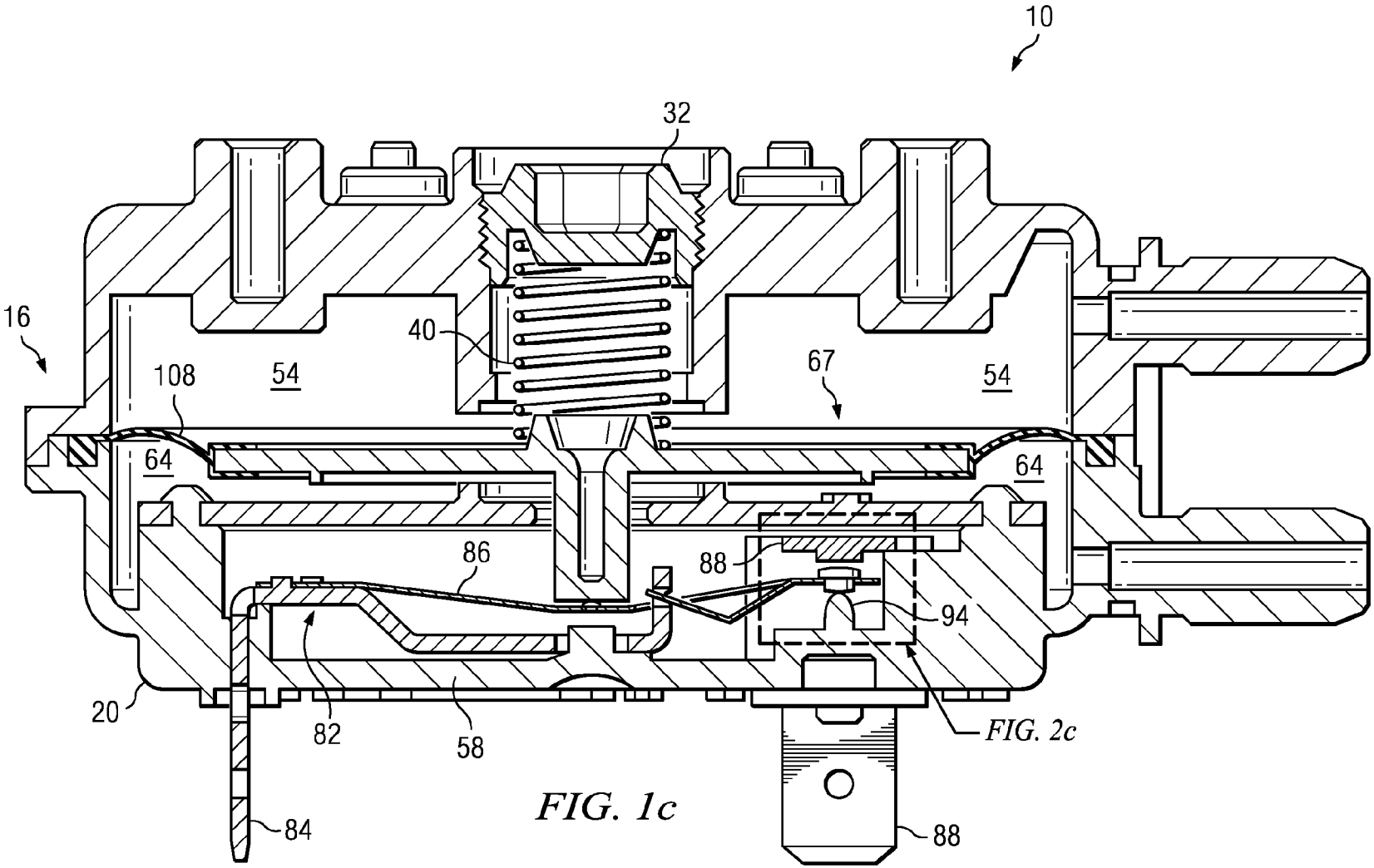
FIG. 1*c* is a cross sectional view of a pressure differential switch assembly in accordance with another embodiment, wherein the included diaphragm assembly is in contact with the blade spring.

In the examples shown in FIGS. 1*a*, 1*b*, and 1*c*, the pressure differential switch assembly 10 can include a generally cylindrical housing 16. The housing 16 can enclose moving parts of the pressure differential switch assembly 10 and can be formed from an upper housing member 18 and a lower housing member 20. The upper housing member 18 and the lower housing member 20 can be configured to mate with each other when assembled and can be constructed from any appropriate material that can withstand fluid pressures to which the pressure differential switch assembly 10 will be subjected. In many applications, use of a substantially rigid material to construct the housing 16 may be desired. Such a material may be a metal such as steel, brass or other alloy, a ceramic, a plastic such as polyvinyl chloride (PVC) or other appropriate plastic, a polycarbonate, or a carbon fiber composite. Other suitable materials may also be used.

A plurality of extrusions 22 are affixed to a top wall 24 of the upper housing member 18. Depending upon a specific fabrication method employed, each of the extrusions 22 can be formed as an integral part of the upper housing member 18 or can be affixed to the top wall 24. Each of the extrusions 22 can be used as an anti-rotation element when mounting the pressure differential switch assembly 10 to a mounting bracket or a panel.

A plurality of bosses 26 can also be affixed to the top wall 24 of the upper housing unit 18. As with the plurality of extrusions 22, the plurality of bosses 26 can be formed as an integral part of the upper housing member 18 or can be affixed to the top wall 24 of the upper housing member 18. Walls of each boss 26 in the plurality of bosses define a recess 28 that can receive a fastener, such as a self-tapping screw or other appropriate fastener, for mounting the pressure differential switch assembly 10, either in conjunction with a mounting bracket or directly to another surface.

Portions of the upper wall 24 of the upper housing member 18 define an opening 30 through the upper wall 24. The opening 30 can be threaded for at least a portion of its length to accept a set screw 32. In the example shown, the threads of the opening 30 terminate before the end of the length of the opening 30 to terminate travel of the set screw 32 when adjusted.

The set screw 32 can include threads that are mated to the threads of the opening 30. Walls 34 of the set screw 32 define a generally hexagonal opening 36 that can be configured to accept an end of a hex wrench (not shown) for adjustment. Alternatively, another configuration, such as a slot for a standard screwdriver, a cross for a Phillips screwdriver, a Torx opening for a Torx wrench, or another suitable adjustment mechanism can be used.

The set screw 32 also can include a protrusion 38 that can be used as a locating or positioning device for a resilient member such as a coil spring 40. The coil spring 40 can be placed in compression when the pressure differential switch assembly 10 is assembled. The amount of compression can be at least partially adjusted by positioning the set screw 32 within the opening 30 of the upper housing member 18. Those of ordinary skill in this art area will recognize from this description that the exact amount of compressive force to be applied or desired in a given instance will differ depending upon a variety of factors including sizes of components and materials used. Additionally, the coil spring 40 can be replaced by, or supplemented with, other suitable types of resilient members such as those made from elastomers, among others.

The upper housing 18 can include a generally cylindrical side wall 42. The side wall 42 terminates in an annular lip 44 can be located at the bottom of the side wall 42. This annular lip 44 can include a top lip portion 46 and a side lip portion 48. The top lip portion 46 can be generally annular and radiates outwardly from the bottom of the side wall 42 in a plane that can be substantially parallel to a plane occupied by the top wall 24 of the upper housing member 18. A plurality of openings (not shown) are dispersed at approximately equal intervals around the circumference of the generally annular top lip portion 46 of the annular lip 44. Each of the openings of the plurality of openings extends through the entire thickness of the top lip portion 46 to create a passage through the top lip portion 46. The side lip portion 48 of the annular lip 44 can be generally cylindrical and approximately concentric with the side wall 42.

The upper housing member 18 can include an upper inlet port 50 that can be integral with the side wall 42, as shown in FIGS. 1*a* and 1*b*. The upper inlet port 50 can be generally cylindrical and can be configured to accept a hose to carry gases or fluids. One suitable hose that can be used has an inner diameter that can be approximately equal to the outer diameter of the upper inlet port 50 so as to provide a friction fit between the hose and the upper inlet port 50. If desired in a specific application, a hose clamp, an adhesive, or another suitable means to secure a hose to the upper inlet port 50 can be used. A fluid passage 52 extends through the upper inlet port 50 and further through the side wall 42 to provide fluid communication between an upper pressure chamber 54 and a conduit (not shown) that can be coupled to the upper inlet port 50. The upper pressure chamber 54 can be at least partly defined by the upper housing member 18.

The lower housing member 20 can be generally cylindrical and can be configured to mate with the upper housing member 18 to form the housing 16 of the pressure differential switch 10. The lower housing member 20 can include a generally cylindrical side wall 56 and a bottom wall 58. A plurality of tabs 97 (shown in FIG. 3) protrude from a generally annular lip 60. Each tab 97 of the plurality of tabs 97 can be configured to protrude through one of the openings of the plurality of openings in the top lip portion 46 of the annular lip 44 of the upper housing member 18.

When a polycarbonate is used to form the upper housing member 18 and the lower housing member 20, heat can be applied to a part of each of the plurality of tabs 97 that extends past the surface of the top lip portion 46 of the annular lip 44 of the upper housing member 18 (FIGS. 1*a*, 1*b*, and 1*c*). When heated, the polycarbonate can be deformed to fasten each of the tabs 97 of the plurality of tabs 97 of the bottom housing member 20 within each of the openings of the plurality of openings of the upper housing member 18 to fasten the upper housing member 18 and the lower housing member 20 together. Depending upon the material used for construction, other suitable fastening methods, such as welding, bonding, gluing, or crimping, among others, can be used.

The lower housing member 20 can include a lower inlet port 62 that can be integral with the side wall 42, as shown in FIGS. 1*a* and 1*b*. The lower inlet port 62 can be generally cylindrical and can be configured to accept a hose in a similar fashion as the upper inlet port 50. A fluid passage 63 extends through the lower inlet port 62 and further through the side wall 56 to provide fluid communication between a lower pressure chamber 64 and a conduit (not shown) that can be coupled to the lower inlet port 62. The lower pressure chamber 64 can be at least partly defined by the lower housing member 20.

The lower housing member 20 also can include an inner wall 66. The inner wall 66 can include a peripheral edge 68 and a plurality of posts 70 that can be used as locating features for the switch cover plate 74 (FIGS. 1*a*, 1*b*, and 1*c*). The inner wall 66 partly defines a switch assembly chamber 72 in cooperation with the switch cover plate 74 (FIGS. 1*a*, 1*b*, and 1*c*).

The switch cover plate 74 can include a plurality of alignment openings 76 and can be positioned on the peripheral edge 68 of the inner wall 66. Positioning of the switch cover plate 74 can be assisted by locating each of the plurality of alignment openings 76 over one of the posts 70 such that each of the posts 70 protrudes through one of the alignment openings 76 of the switch cover plate 74. The switch cover plate 74 can be constructed from the same material as the upper housing member 18, the lower housing member 20, or a different suitable material.

The alignment openings 76 are located at opposing ends of the switch cover plate 74. A protruding ridge 78 can be positioned generally in the center of the switch cover plate 74. In the example depicted, this protruding ridge 78 is generally annular and is generally concentric with a circle formed by a peripheral edge 80 of a generally annular opening through the switch cover plate 74.

The pressure differential switch assembly 10 can include a diaphragm assembly 67 disposed within the housing 16 when assembled. The diaphragm assembly 67 partly defines the upper pressure chamber 54 in cooperation with the upper housing member 18. Additionally, the diaphragm assembly 67 partially defines the lower pressure chamber 64 in cooperation with the lower housing member 20. Further details of the diaphragm assembly 67 are later provided in conjunction with FIGS. 4A and 4B.

The pressure differential switch assembly 10 can include a blade spring assembly 82. The blade spring assembly 82 can include a first terminal 84 that can be designated as a common terminal. The first terminal 84 is shown in this example as protruding through the bottom wall 58 of the lower housing member 20 to provide an electrical contact that can be outside the housing 16. A blade spring 86 can be affixed in an electrically conductive manner to the first terminal 84. The blade spring 86 can include an electrical contact 98 as shown in FIGS. 1*a*-1*c* and 2*a*-2*c*. Further details of the blade spring assembly 82 are provided in conjunction with the discussion accompanying FIGS. 9-12.

A second terminal 88 protrudes through the bottom wall 58 of the lower housing member 20 to provide a second electrical contact exterior to the housing 16. This second terminal 88, in the example shown in FIGS. 1*a* and 1*b*, can be used as a normally open terminal. In other modes of operation, with appropriate and apparent modifications to either the depicted configuration of the pressure differential switch assembly 10 or components that can be connected to the pressure differential switch assembly 10, the second terminal 88 can be used as a normally closed terminal. Further details of the second terminal 88 are shown in and discussed in conjunction with FIGS. 5*a* and 5*b*.

A third terminal 90 can provide a normally closed terminal contact. The third terminal can also protrude through the bottom wall 58 of the lower housing member 20 to provide an electrical contact exterior to the housing 16. For clarity of illustration, a blade portion of the third terminal 90 that can so protrude through the bottom wall 58, is not shown in FIGS. 1*a* and 1*b*. As previously described, the third terminal 90, with appropriate and apparent modifications can be used as a normally open terminal. Further details of the third terminal 90 are shown in and discussed in conjunction with FIGS. 6*a* and 6*b*. Each of the terminals 84, 88, and 90 can be constructed from any suitable electrically conductive material, such as brass or another suitable material.

In one embodiment, the pressure differential switch assembly 10 can include three electrical contacts exterior to the housing 16, as shown in FIG. 1*a*. These exterior contacts are the first (common) terminal 84, the second (normally open) terminal 88, and the third (normally closed) terminal 90. In operation, the pressure differential switch assembly 10 can be connected to other electrical components in a manner that creates two electrical circuits. The first circuit can include a conduction pathway that can include the first (common) terminal 84, the blade spring 86, and the third (normally closed) terminal 90. The second circuit can include a conduction pathway that can include the first (common) terminal 84, the blade spring 86, and the second (normally open) terminal 88.

The set screw 32 can be adjusted by moving its position to selectively compress the coil spring 40 between the set screw 32 and the diaphragm assembly 67. In the current example discussed here, this compression of the coil spring 40 selects the amount of preload or bias that can be supplied through the diaphragm assembly to the blade spring assembly 82. The blade spring 86 of the now biased or preloaded blade spring assembly 82 can be forced into contact with the third (normally closed) terminal 90, as shown in FIG. 1*a*, thereby completing one of the two electrical circuits in this example.

Figure 2B:
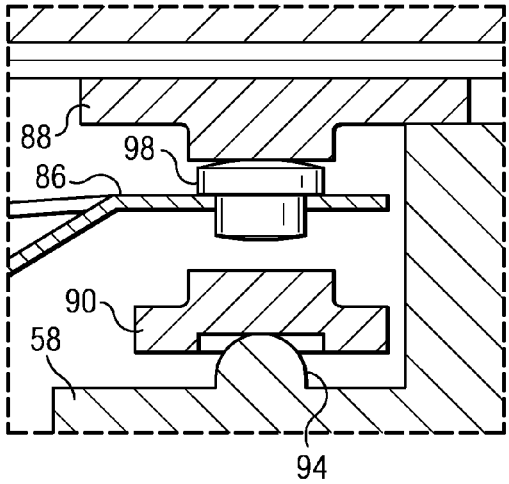
FIG. 2*b* is an enlarged view of a portion of the pressure differential switch assembly shown in FIG. 1*b;*

Fluid pressures in upper pressure chamber 54 and lower pressure chamber 64 can vary during operation of equipment with which the pressure differential switch assembly 10 can be used. In one embodiment, fluid pressure level in the lower pressure chamber 64 can be greater than fluid pressure level in the upper pressure chamber 54. The diaphragm assembly 67 will be urged toward the upper pressure chamber 54 when a difference in these pressures equals or exceeds a predetermined amount sufficient to overcome an amount of force supplied by the bias or preload of the coil spring 40. Accordingly, the blade spring 86 can be moved upwardly such that the electrical contact 98 of the blade spring 86 disengages from the third (normally closed) terminal 90 and engages the second (normally open) terminal 88, as depicted in FIG. 1*b* and 2*b*.

When the blade spring 86 is actuated in this manner, the first electrical circuit can be opened and the second electrical circuit can be closed. The opening and closing of circuits in this manner can be used to deactivate a piece of equipment and contemporaneously activate an annunciator to indicate that such an equipment deactivation has occurred. Similarly, the opening and closing of circuits in this manner can be used to deactivate a first piece of equipment and contemporaneously activate a second piece of equipment. Other uses are also possible and will be apparent to those of ordinary skill in this art area from reading this disclosure.

FIG. 1*c* depicts the pressure differential switch assembly 10 without the third (normally closed) terminal 90. In this example, the blade spring assembly 82 is shown in a biased or preloaded state, similar to the example shown in FIG. 1*a*. In this state, the blade spring 86 can be normally at rest on a terminal stop 94. The terminal stop 94 is shown as integral to the bottom wall 58 of the lower housing member 20.

In this configuration, the pressure differential switch assembly 10 can include two electrical contacts exterior to the housing 16. These exterior contacts are the first (common) terminal 84 and the second (normally open) terminal 88. In operation, the pressure differential switch assembly 10 can be connected to other electrical components in an electrical circuit. This circuit can include a conduction pathway that can include the first (common) terminal 84, the blade spring 86, and the second (normally open) terminal 88.

The set screw 32 can be adjusted by moving its position to selectively compress the coil spring 40 between the set screw 32 and the diaphragm assembly 67. In the current example discussed here, this compression of the coil spring 40 selects the amount of preload or bias that can be supplied through the diaphragm assembly to the blade spring assembly 82. The blade spring 86 of the now biased or preloaded blade spring assembly 82 can be forced into contact with the terminal stop 94, thereby keeping the electrical circuit between the first (common) terminal 84, and the second (normally open) terminal 88 open.

Fluid pressures in upper pressure chamber 54 and lower pressure chamber 64 can vary during operation of equipment with which the pressure differential switch assembly 10 can be used. In one embodiment, fluid pressure level in the lower pressure chamber 64 can be greater than fluid pressure level in the upper pressure chamber 54. The diaphragm assembly 67 will be urged toward the upper pressure chamber 54 when a difference in these pressures equals or exceeds a predetermined amount sufficient to overcome an amount of force supplied by the bias or preload of the coil spring 40. Accordingly, the blade spring 86 can be moved upwardly such that the electrical contact 98 of the blade spring 86 from contact with the terminal stop 94 and engages the second (normally open) terminal 88, as depicted in FIG. 1*b* and 2*b*.

When the blade spring 86 is actuated in this manner, the electrical circuit can be normally open. The opening and closing of the circuit in the described manner can be used to activate or deactivate an annunciator or other piece of equipment. Other uses are also possible and will be apparent to those of ordinary skill in this art area from reading this disclosure.

FIG. 2*a* depicts the electrical contact 98 of the blade spring 86 in contact with the third (normally closed) terminal 90. This example shows the deactivated state of operation of the pressure differential switch assembly 10 with three terminals as depicted in and described in conjunction with FIG. 1*a*. FIG. 2*b* depicts the electrical contact 98 of the blade spring 86 in contact with the second (normally open) terminal 88. This example shows the activated state of operation of the pressure differential switch assembly 10 with three terminals as depicted in and described in conjunction with FIG. 1*b*.

Figure 2C:
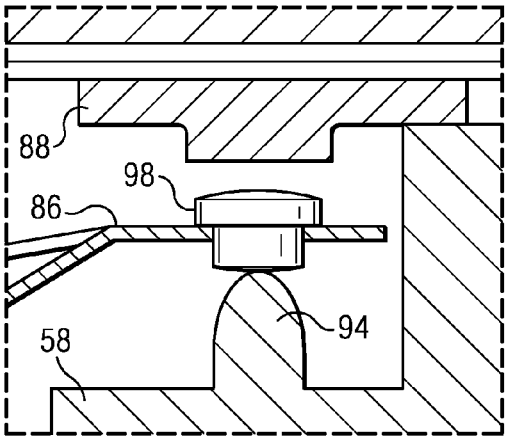
FIG. 2*c* is an enlarged view of a portion of the pressure differential switch assembly shown in FIG. 1*c;*

FIG. 2*c* depicts the electrical contact 98 of the blade spring 86 in contact with the terminal stop 94. This example shows the deactivated state of operation of the pressure differential switch assembly 10 with two terminals as depicted in and described in conjunction with FIG. 1*c*. When activated, the electrical contact 98 of the blade spring 86 would move to contact the second (normally open) terminal 88 and would not be in contact with the terminal stop 94. Although shown as rounded and convex toward the electrical contact 98, the surface of the terminal stop 94 that can be configured to, and in this example does contact the electrical contact 98 of the blade spring 86 can be flat, pointed, or another suitable shape.

Figure 3:
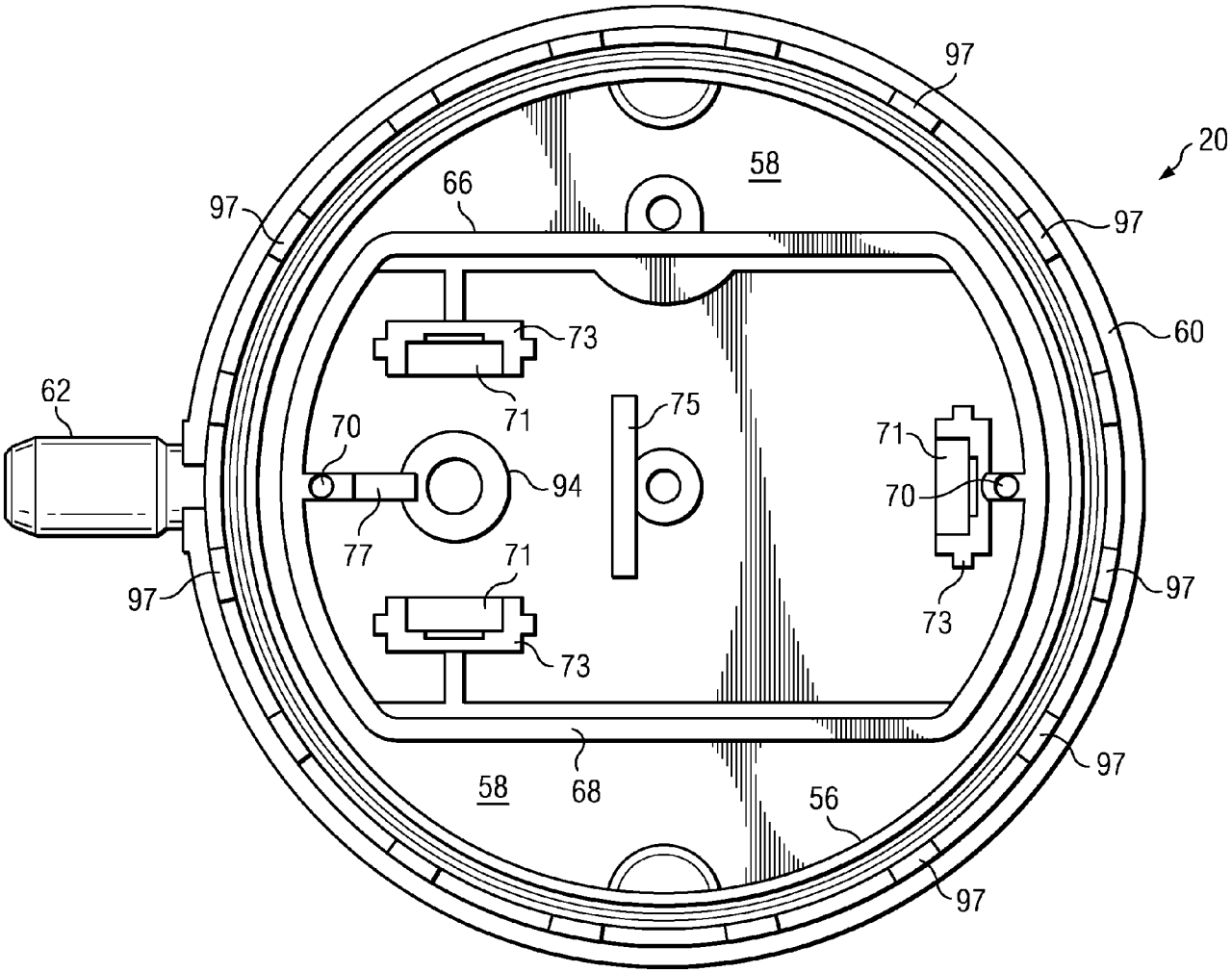
FIG. 3 is a top plan view of the lower portion of the switch housing of FIGS. 1*a* and 1*b;*

FIG. 3 is a top plan view of the lower portion of the housing 16. The bottom wall 58 can include a plurality of terminal openings 71 through which terminals can protrude. Each of the plurality of terminal openings 71 can be partially surrounded by a terminal support wall 73. A central support wall 75 and a side support wall 77 can each partially support the blade switch assembly 82 when assembled.

Figure 4A:
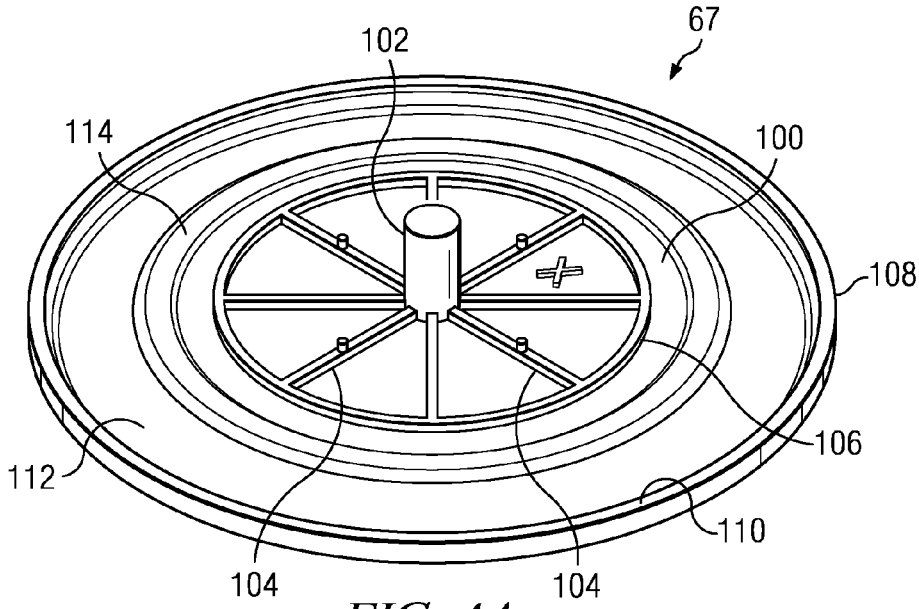
FIG. 4*a* is a perspective view of the diaphragm assembly shown in FIGS. 1*a*-2*c,* with the top portion removed for clarity.
Figure 4B:
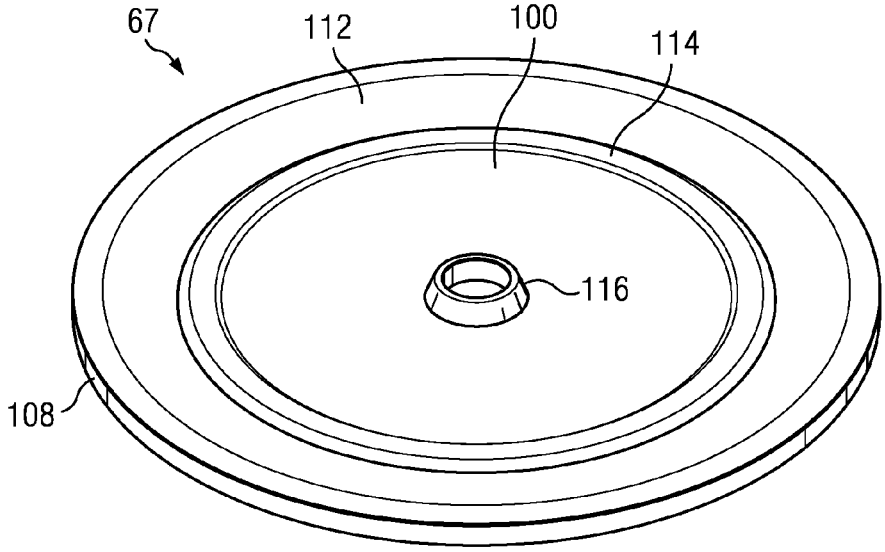
FIG. 4*b* is a perspective view of the diaphragm assembly shown in FIGS. 1*a*-2*c,* and 4*a* with the lower portion removed for clarity.

FIGS. 4*a* and 4*b* are perspective views of the diaphragm assembly 67 from below and above, respectively. The diaphragm assembly 67 can include a substantially rigid disk 100. The disk 100 can be constructed from the same material as the upper housing member 18, the lower housing member 20, or can be made from a different suitable material. A plunger 102 can be positioned generally in the center of the disk 100. A plurality of radial ridges 104 and a circular ridge 106 are affixed to, or formed integrally with, the disk 100.

A flexible member 108 can be generally annular and extends radially from the disk 100. The flexible member 108 can be constructed from silicone or another suitable elastomer. A sealing ridge 110 can be located along a peripheral edge of the flexible member 108. This sealing ridge 110 can be positioned between the upper housing member 18 (FIGS. 1*a*, 1*b*, and 1*c*) and the lower housing member 20 (FIGS. 1*a*, 1*b*, and 1*c*) to assist in creating a seal between the upper and lower housing members 18, 20 in a similar manner as a gasket. The flexible member 108 also can include a convolution 112 that can be convex toward the upper housing member 18 with no pressure differential between the upper and lower pressure chamber 54, 64.

An attachment region 114 provides an area where the flexible member 108 can be secured to the disk 100. In this example, an inner circumference of the flexible member 108 can be configured to form a channel into which the peripheral edge of the disk 100 can fit. The flexible member 108 can be secured to the disk 100 by bonding, for example using various adhesives, or by another appropriate method.

A positioning ridge 116 can be positioned at approximately the center of the disk 100. This positioning ridge 116 can be generally annular and can be approximately centered in the disk 100. Additionally, the positioning ridge 116 can be configured to accept one end of the coil spring 40 (FIGS. 1*a*, 1*b*, and 1*c*) to provide a means for positioning the coil spring 40. In applications where a different resilient member can be used in place of, or in addition to, the coil spring 40, the positioning ridge can be modified to accommodate the resilient member used or even eliminated completely if appropriate.

Figure 5A:
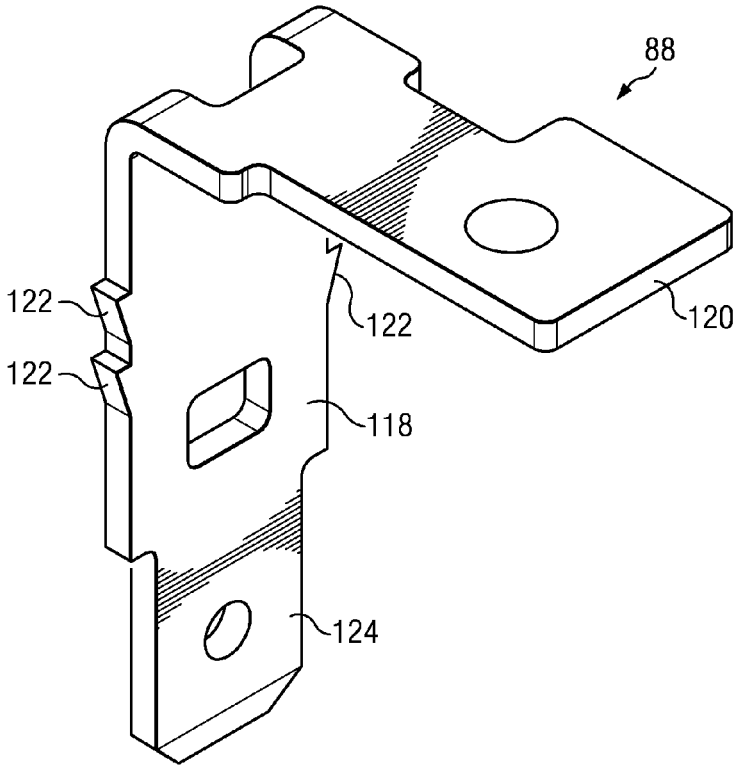
FIG. 5*a* is a perspective view of the normally closed contact and terminal of the pressure differential switch assembly of FIGS. 1*a*-1*b* and 2*a*-2*b;*
Figure 5B:
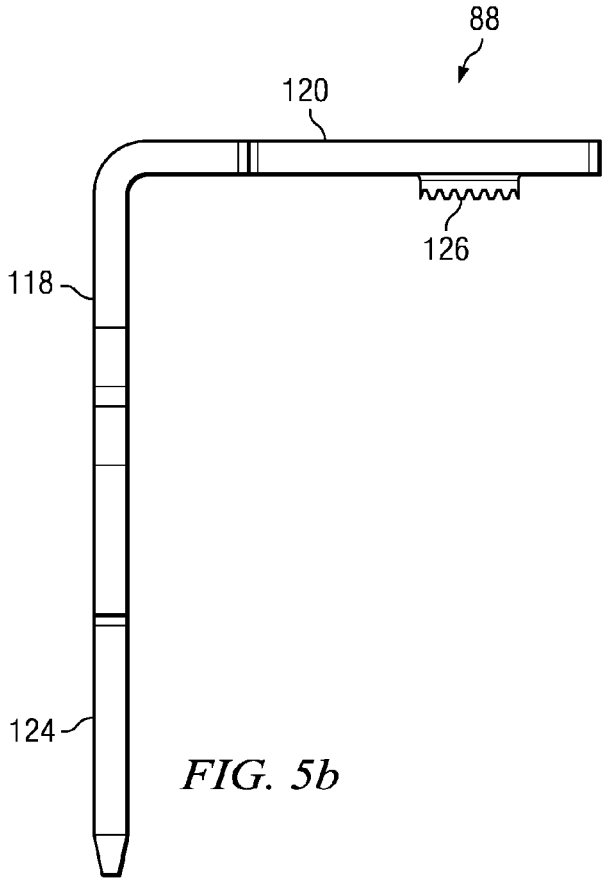
FIG. 5*b* is a side view of the normally closed contact and terminal shown in FIG. 5*a;*

As illustrated in FIGS. 5*a* and 5*b*, the second (normally open) terminal 88 can be generally L-shaped. The second (normally open) terminal 88 has a principal leg 118 and a contact supporting leg 120. In this specific example, the principal leg 118 of the second (normally open) terminal 88 can be longer than the contact supporting leg 120. The principal leg 118 can include a plurality of securing tabs 122 configured to secure the second (normally open) terminal 88 to the lower housing member 20 (FIGS. 1*a*, 1*b*, and 1*c*). Also, the principal leg 118 can include a spade portion 124 that can be configured to accept an electrical connector. Other appropriate means for connecting an electrical conductor can also be used. The contact supporting leg 120 of the second (normally open) terminal 88 can include an electrical connector 126. The electrical connector 126 can be configured to provide an electrical contact point for the electrical contact 98 of the blade spring 86.

Figure 6A:
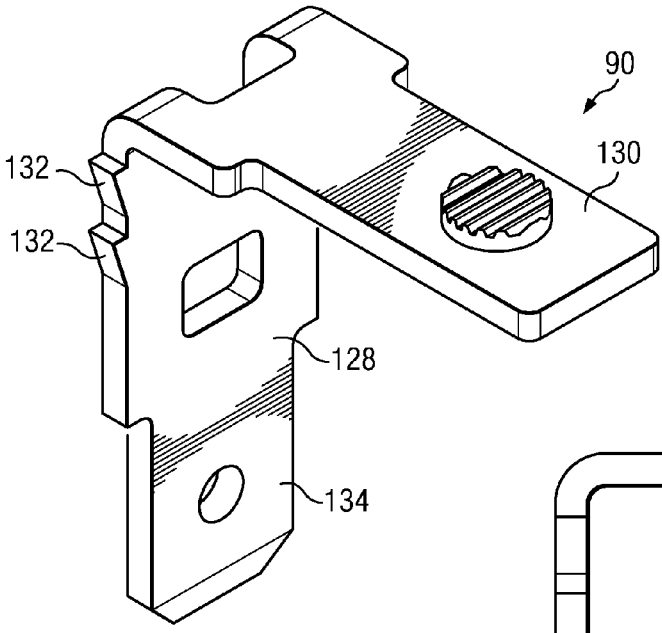
FIG. 6*a* is a perspective view of the normally open contact and terminal of the pressure differential switch assembly of FIGS. 1*a*-1*b* and 2*a*-2*b;*
Figure 6B:
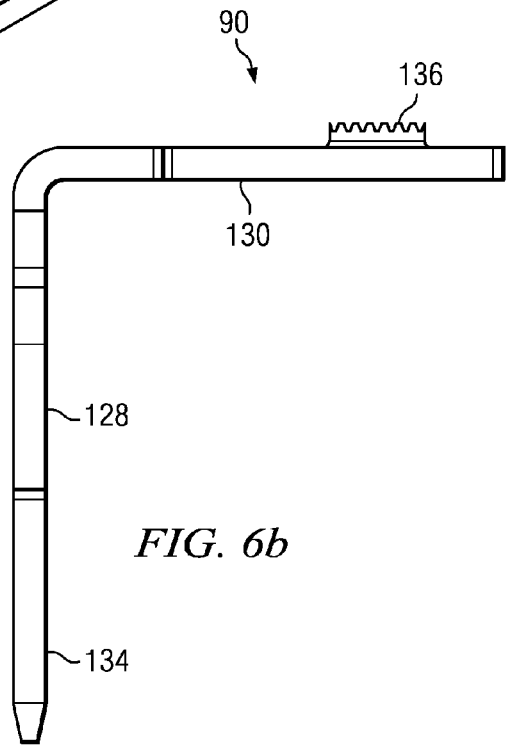
FIG. 6*b* is a side perspective view of the normally open contact and terminal shown in FIG. 6*a;*

As illustrated in FIGS. 6*a* and 6*b*, the third (normally closed) terminal 90 can be generally L-shaped. The third (normally closed) terminal 90 has a principal leg 128 and a contact supporting leg 130. In this specific example, the principal leg 128 of the third (normally closed) terminal 90 can be longer than the contact supporting leg 130. The principal leg 128 can include a plurality of securing tabs 132 configured to secure the third (normally closed) terminal 90 to the lower housing member 20 (FIGS. 1*a*, 1*b*, and 1*c*). Also, the principal leg 128 can include a spade portion 134 that can be configured to accept an electrical connector. Other appropriate means for connecting an electrical conductor can also be used. The contact supporting leg 130 of the third (normally closed) terminal 90 can include an electrical connector 136. The electrical connector 136 can be configured to provide an electrical contact point for the electrical contact 98 of the blade spring 86.

When assembled in a three-contact implementation of the pressure differential switch 10, and as depicted in detail in FIGS. 2*a* and 2*b*, the electrical contact 126 of the second (normally open) terminal 88, the contact 98 of the blade spring 86, and the electrical contact 136 of the third (normally closed) terminal 90 are generally positioned in a stack one above the other. In a two-contact implementation, as depicted in FIG. 2*c*, the electrical contact 136 of the third (normally closed) terminal 90 is shown as replaced by the terminal stop 94.

Figure 7:
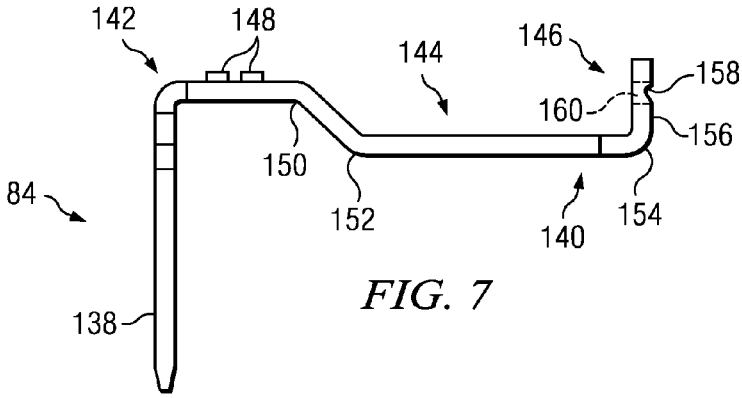
FIG. 7 is a side view of the common terminal shown in FIGS. 1*a*-2*c;*

FIG. 7 is a side view of the first (common) terminal 84. The first (common) terminal 84 can be generally L-shaped. The first (common) terminal 84 has a principal leg 138 and a blade spring supporting leg 140. In this specific example, construction of the principal leg 138 of the first (common) terminal 84 can be substantially similar to that of either the principal leg 118 of the second (normally open) terminal 88 (FIGS. 5*a* and 5*b*) or the principal leg 128 of the third (normally closed) terminal 90 (FIGS. 6*a* and 6*b*). For brevity, those details will not be repeated here.

The blade spring supporting leg 140 can include a proximal end 142, a deflection region 144, and a distal end 146. The proximal end 142 can include a plurality of stakes 148 on an upper surface. In this specific example, the deflection region 144 can be formed by introducing two bends measuring approximately 45° at reference points 150 and 152. This deflection region 144 can provide an area into which the blade spring 86 (FIGS. 1*a* and 1*c*) can move.

The distal end 146 of the blade spring supporting leg 140 can be upturned at approximately a 90° angle at reference point 154 to form a retainer 156. The retainer 156 can include a beveled region 158 and defines a passage 160 that extends through the entire thickness of the retainer 156. Further details of the retainer 156 are provided in conjunction with FIG. 11.

Figure 8:
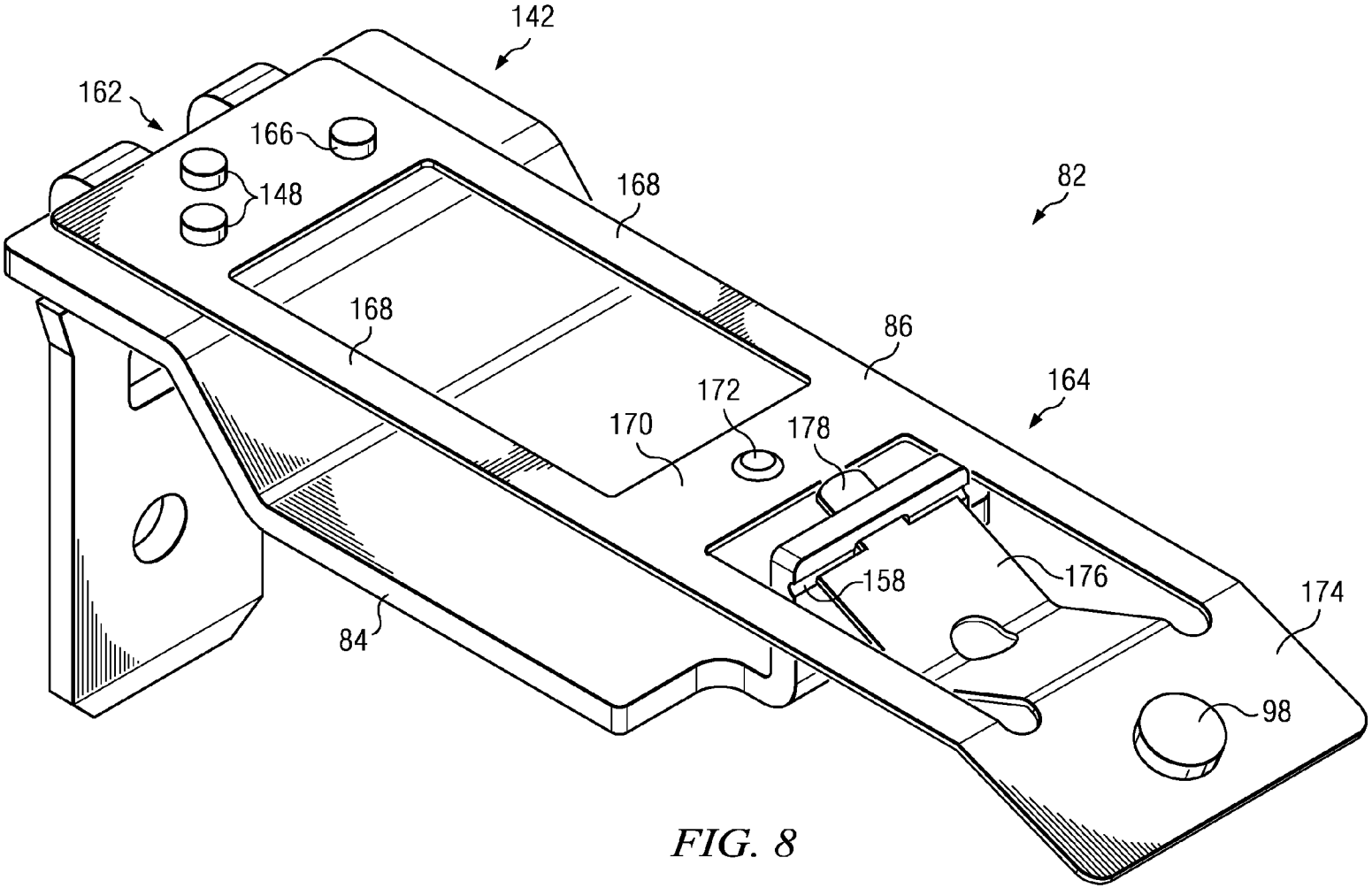
FIG. 8 is a perspective view of the blade spring and common terminal of FIGS. 1*a*-2*c;*

FIG. 8 is a perspective view of the blade spring assembly 82. The blade spring assembly 82, in this specific example, can include the first (common) terminal 84 and the blade spring 86. The blade spring 82 further can include a proximal end portion 162 and a distal end portion 164. The proximal end portion 162 of the blade spring 86 is shown affixed in an electrically conductive manner to the proximal end 142 of the first (common) terminal 84 by the stakes 148. A locating stake 166 is also depicted at the proximal end 142 of the first (common) terminal 84.

The blade spring 86 can include a plurality of flexible tension arms 168. The flexible tension arms 168 extend from the proximal end portion 162 to the distal end portion 164 of the blade spring 86. A pressure contact region 170 can be located between the proximal end portion 162 and the distal end portion 164. The pressure contact region 170 extends between, and can be connected to, each of the plurality of flexible tension arms 168. Additionally, a raised dimple 172 can be located approximately in the center of the pressure contact region 170. The pressure contact region 170 can be integral with the flexible tension arms 168, as shown in FIG. 8. The dimple 172 can have a variety of shapes or in one embodiment, can be omitted. In such an embodiment, an end of the plunger 102 of the diaphragm assembly 67 (FIGS. 4*a* and 4*b*) can be appropriately shaped to contact the flexible tension arms 168.

The blade spring 86 can include a compression spring 176. The compression spring 176 can be integral with the distal end portion 164 of the blade spring 86 and can extend generally proximally from the distal end portion 164 of the blade spring 86. In one embodiment, the proximal end portion 162, the distal end portion 164, the flexible tension arms 168, the pressure contact region 170, and the compression spring 176 can be formed as a unitary member.

The blade spring 86 can be formed from a sheet of beryllium copper alloy that can have a hardness ranging from about TM00 to about TM08. In certain embodiments, the beryllium copper alloy, or other material used to form a blade spring, can have a thickness ranging from about 0.002 inches to about 0.008 inches. In one embodiment, the thickness can range from about 0.003 inches to about 0.005 inches.

The compression spring 176 can be formed to include a generally V-shaped leaf spring element that can include a first leg 184 and a second leg 186. One manner of forming or constructing the compression spring 176 can be to remove a generally U-shaped section of material from a region, such as region 188, of an elongate piece of beryllium copper alloy. The first leg 184 and the second leg 186 can be configured to form an angle ranging from about 15° to about 165° when not under load. In the depicted example, the included angle between the first leg 184 and the second leg 186 can be about 135° in an unloaded state.

Figure 9:
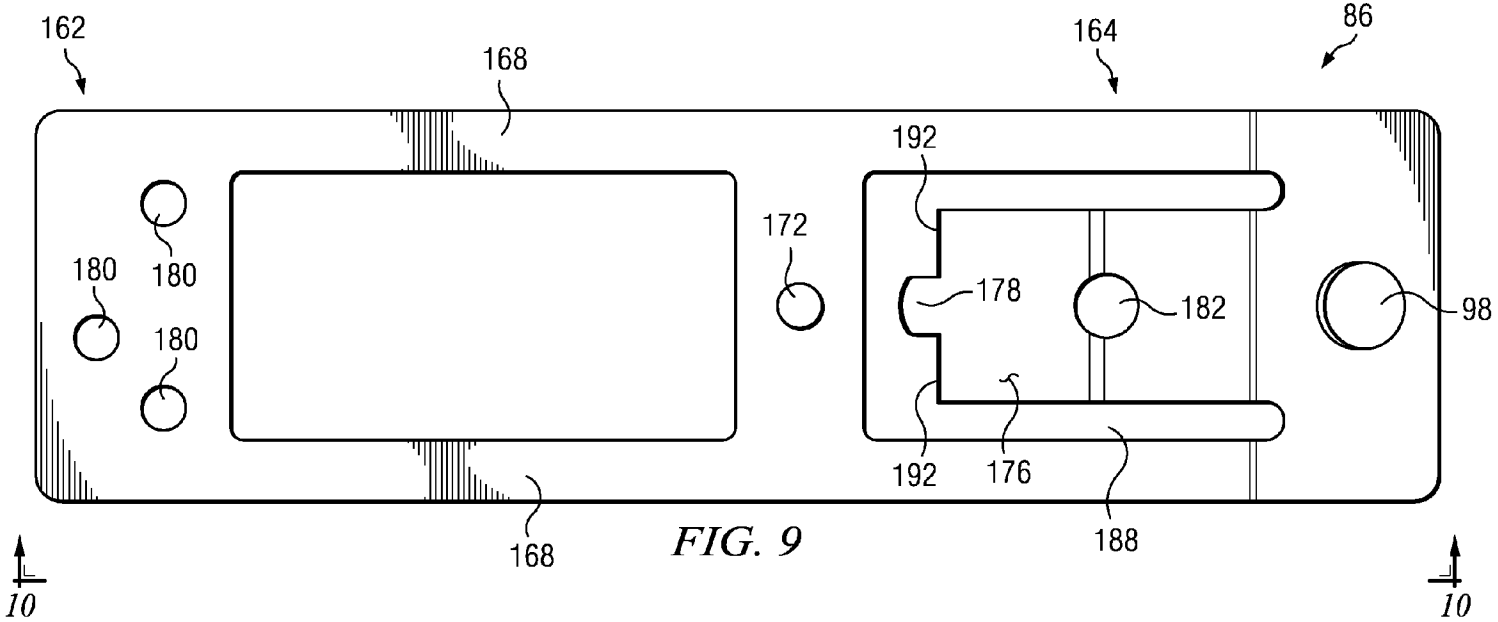
FIG. 9 is a top plan view of the blade spring shown in FIGS. 1*a*-2*c,* and 8.
Figure 10:
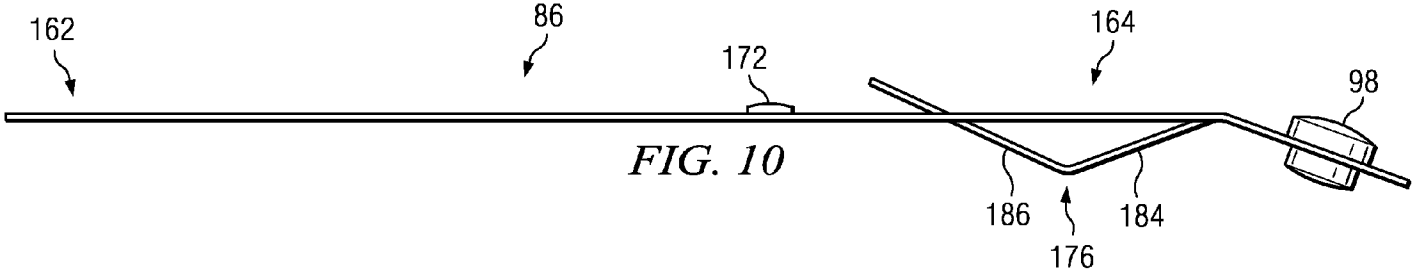
FIG. 10 is a side view of the blade spring shown in FIGS. 1*a*-2*c,* and 8-9.

The distal end portion 164 of the blade spring 86 can include the electrical contact 98. As illustrated in FIG. 9, the electrical contact 98 can be shown as carried by the distal end portion 164 of the blade spring 86. The compression spring 176 can include a locating tab 178 that can be configured to pass though the passage 160 of the retainer 158 of the first (common) terminal 84. Further details of the construction of the blade spring 86 are provided in conjunction with the discussion accompanying FIGS. 9 and 10.

A plurality of stake openings 180 through which the stakes 148 and locating stake 166 (FIG. 8) can protrude can be located at the proximal end portion 162. Additionally, a the first leg 184 and the second leg 186 define an spring adjustment opening 182 for changing a spring constant of the compression spring 176. Changing the size of the spring adjustment opening 182 can change the spring constant of the compression spring 176. The exact size of the spring adjustment opening 182 depends on variables that can include material choice for construction of the blade spring 86 and can vary for any particular application. Alternatively, additional holes or smaller holes can be used instead of the depicted spring adjustment opening 182. Also, approaches such as selectively increasing or reducing the thickness of the blade spring 86 or by forming notches in side edges of the compression spring 176 can be employed to adjust the spring constant. Additionally, other adjustments can be made. For example, the width of each of the flexible tension arms 168 can be adjusted to achieve a desired stiffness and other characteristics of the blade spring 86 for a particular application.

Figure 11:
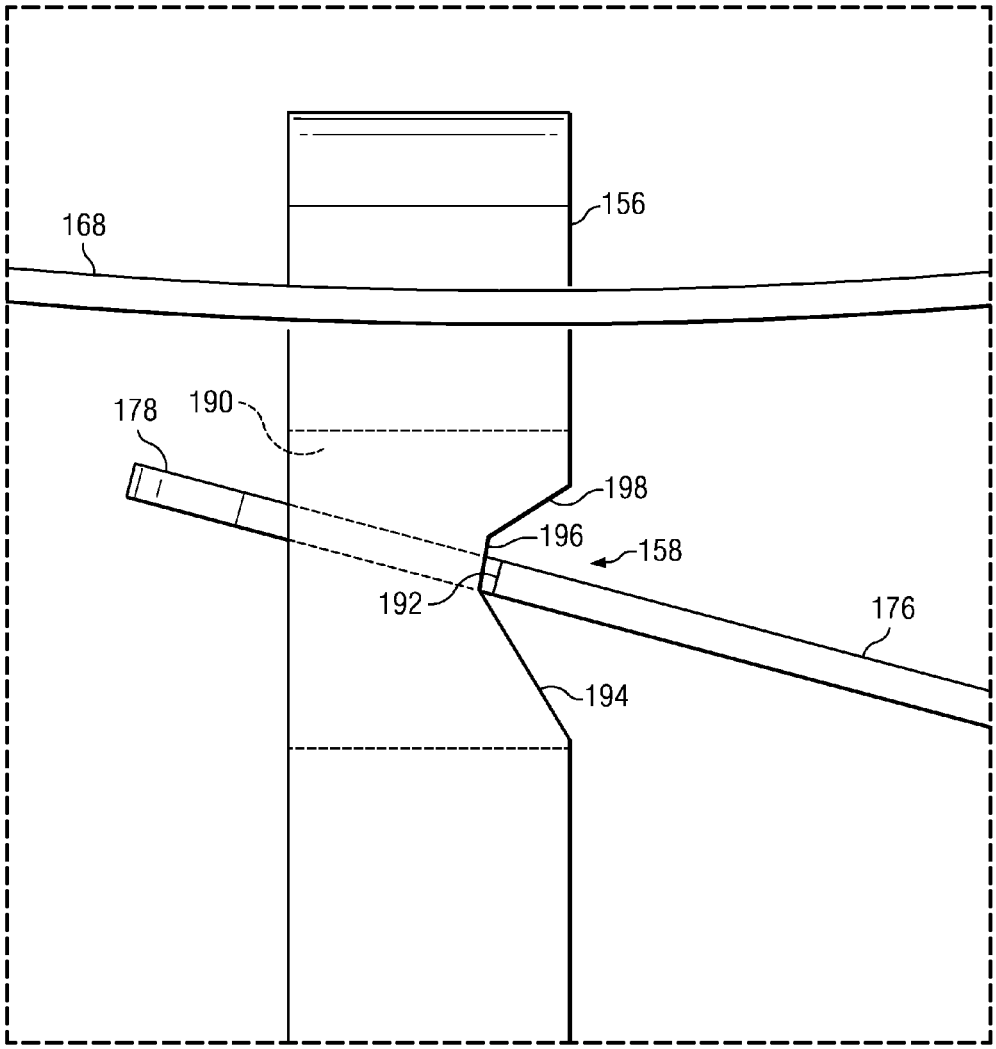
FIG. 11 is an enlarged view of the blade spring shown in FIGS. 1*a*-2*c,* and 8-10 depicting the interaction between an included tab and the common terminal in accordance with one embodiment.

As shown in FIG. 11, the beveled region 158 of the retainer 156 can extend the entire width of the retainer 156 to form a groove 190. The groove 190 can be configured to cooperate with end portions 192 of the compression spring 176 of the blade spring 86. The groove 190 can include a lower surface 194, a medial surface 196, and an upper surface 198.

The lower surface 194, in this specific example, can be angled so that the second leg 186 of the compression spring 176 normally does not contact the lower surface 194 even during operation when the blade spring 86 bends. In one manner of operation, as the blade spring 86 bends, the second leg 186 can rock within the groove 190.

Figure 12A:
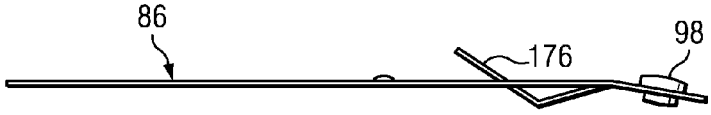
FIGS. 12*a*-12*d* depict a series of steps for assembling the blade spring and the common terminal in accordance with one embodiment.
Figure 12B:
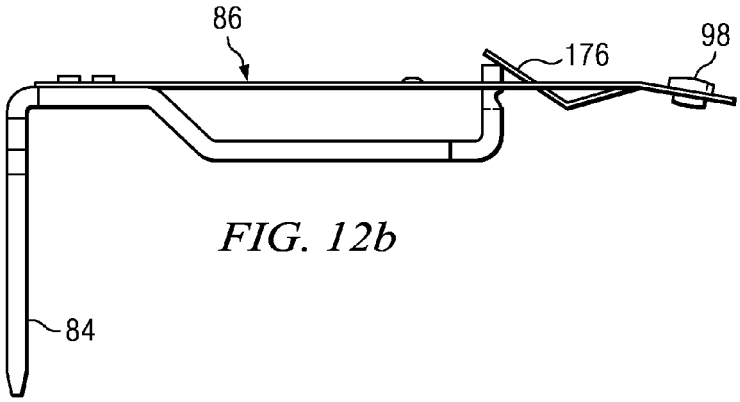
Figure 12C:
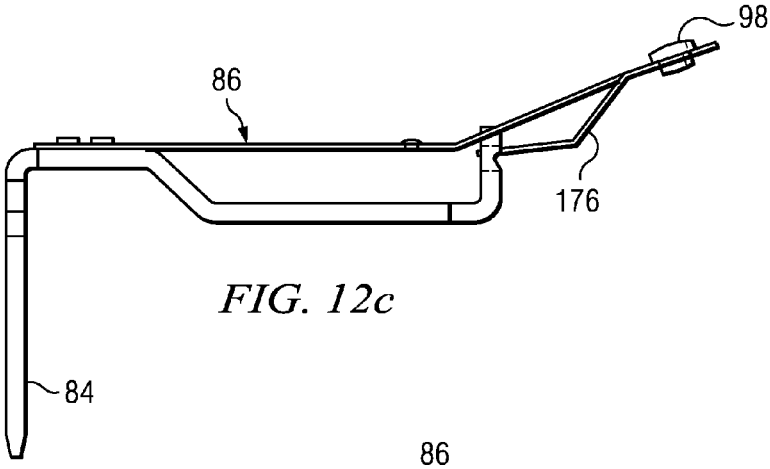
Figure 12D:
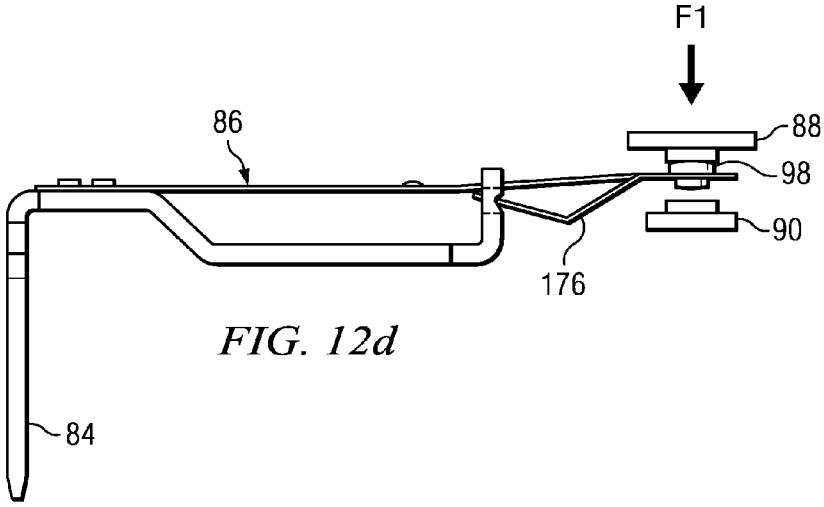

It will be appreciated that FIGS. 12*a*-12*d* depict the assembly of the blade spring assembly 82 and interaction of the blade spring 86, first terminal 84, and second terminal 88 according to one embodiment. FIG. 12*a* illustrates a blade spring 86 separated from the first terminal 84 and FIG. 12*b* illustrates the proximal end portion 162 of the blade spring 86 staked to the first terminal 84. It will be appreciated from FIG. 12*b*, that when the locating tab 178 is disengaged from the slot the retainer 156 can support the compression spring 176. However, as depicted by FIG. 12*c*, the locating tab 178 may be inserted into the groove 190 such that the compression spring 176 biases the distal end portion 164 of the blade spring 86 away from the first terminal 84. The blade spring assembly 82 can be provided within the pressure differential switch assembly 10. As illustrated in FIG. 12*d*, the second terminal 88 can restrain the distal end portion 164 of the blade spring 86 from taking the position illustrated in FIG. 12*c*. The compression spring 176 can accordingly bias the electrical contact 98 against the force F1 applied by the second terminal 88 to maintain electrical contact between the blade spring 86 and the second terminal 88.

Figure 12E:
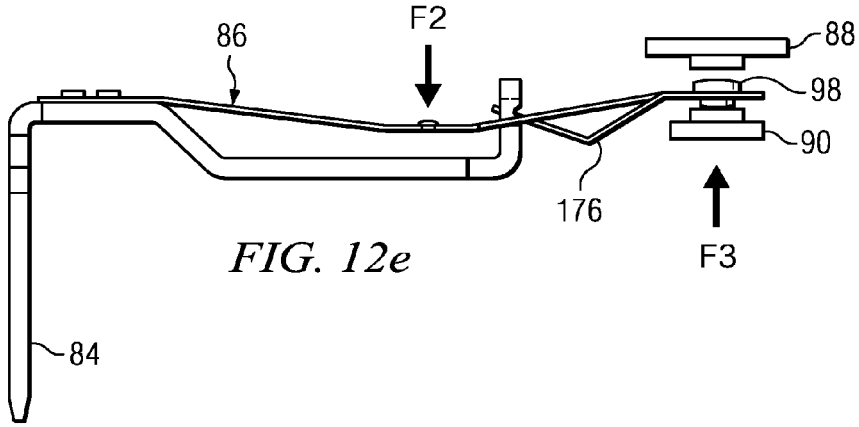
FIGS. 12*e*-12*f* depict the operation of the blade spring.
Figure 12F:
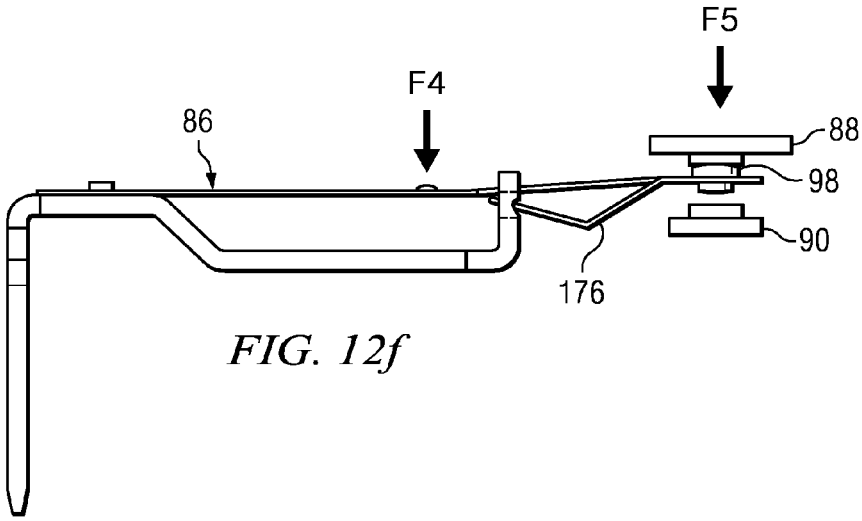

As described above, the diaphragm assembly 67 may actuate as a result of a change in differential pressure between the upper pressure chamber 54 and the lower pressure chamber 64. It will be appreciated that FIGS. 12*e* and 12*f* depict the operation of the blade spring assembly 82 in response to such actuation. In one embodiment as illustrated in FIG. 12*e*, when the pressure in the upper pressure chamber 54 and the pressure in the lower pressure chamber 64 is the same, the diaphragm assembly 67 can apply a force, F2 to the blade spring 86 such that the blade spring 86 is deflected with respect to the first terminal 84. It will be appreciated that when the blade spring 86 is deflected into such a configuration, the distal end portion 164 of the blade spring 86 can engage the third terminal 90. The compression spring 176 can accordingly bias the electrical contact 98 against the force F3 applied by the third terminal 90 to maintain electrical contact between the electrical contact 98 and the third terminal 90. When the pressure in the lower pressure chamber 64 increases with respect to the upper pressure chamber 54, the diaphragm assembly 67 can move away from the blade spring assembly 82 thereby decreasing the force applied to the blade spring 86. In one embodiment as illustrated in FIG. 12*f*, a pressure increase in the lower pressure chamber 64 can cause the diaphragm assembly 67 to apply a force, F4. In such an embodiment, the force F4 is less than the force F2 depicted in FIG. 12*e*, and the blade spring 86 accordingly assumes a non-deflected configuration. It will be appreciated that when the blade spring 86 is in such a non-deflected configuration, the electrical contact 98 can engage the third terminal 90. The compression spring 176 can accordingly bias the electrical contact 98 against the third terminal 90, against the force F5 applied by the third terminal 90, to maintain electrical contact between the blade spring 86 and the third terminal 90.

What has been described above includes examples. It will be appreciated that in another embodiment, the configuration and/or material properties of the coil spring 40 can be selected to accommodate higher pressure in the upper pressure chamber 54 than the pressure in the lower pressure chamber 64. It is, of course, not possible to describe every conceivable combination of components or methodologies for purposes of describing the disclosed systems and methods, but one of ordinary skill in the art may recognize that many further combinations and permutations are possible. Accordingly, the disclosed systems and methods are intended to embrace all such alterations, modifications, and variations.

In particular and in regard to the various functions performed by the above described components, devices, circuits, systems and the like, the terms (including a reference to a "means") used to describe such components are intended to correspond, unless otherwise indicated, to any component which performs the specified function of the described component (for example, a functional equivalent), even though not structurally equivalent to the disclosed structure, which performs the function in these illustrated examples.

In addition, while a particular feature may have been disclosed with respect to only one of several implementations, such feature may be combined with one or more other features of the other implementations as may be desired and advantageous for any given or particular application. Furthermore, to the extent that the terms "includes," and "including" and variants thereof are used, these terms are intended to be inclusive in a manner similar to the term "comprising."

What is claimed is:

1. A blade spring for switching an electrical circuit, comprising:

a proximal end portion configured for electrically conductive attachment to an electrical terminal;

a plurality of flexible tension arms extending from the proximal end portion;

a pressure contact region configured to accept transmission of a physical force to bend at least one of the plurality of flexible tension arms;

a distal end portion integral with the flexible tension arms, the distal end portion including an electrical contact; and a compression spring comprising a first leg and a second leg; wherein the first leg of the compression spring is integral with the distal end portion and extends generally proximally from the distal end portion;

the second leg of the compression spring is integral with the first leg and extends generally proximally from the first leg, the second leg being spaced from each of the proximal end portion and the pressure contact region; and when not under load, substantially the entire first leg extends linearly, substantially the entire second leg extends linearly, and the first leg and the second leg cooperate to form an obtuse angle.

2. The blade spring of claim 1, wherein the second leg is configured nor pivotal connection to a retainer.

3. The blade spring of claim 2, wherein the second leg includes a locating tab.

4. The blade spring of claim 1, wherein the first leg and the second leg cooperate to define an opening, the opening being configured to affect a spring constant of the compression spring.

5. The blade spring of claim 4, wherein the proximal end portion, the plurality of tension arms, and the distal end portion are formed from beryllium copper alloy.

6. The blade spring of claim 5, wherein thickness of the beryllium copper alloy ranges from about two one-thousandths of one inch to about eight one-thousandths of one inch.

7. The blade spring of claim 6, wherein hardness of the beryllium copper alloy ranges from about TM00 to about TM08.

8. A switch assembly comprising:

a blade spring comprising:

a proximal end portion;

a plurality of flexible tension arms extending from the proximal end portion;

a pressure contact region configured to accept transmission of a physical force to bend at least one of the plurality of flexible tension arms;

a distal end portion integral with the flexible tension arms, the distal end portion including an electrical contact; and a compression spring integral with, and extending proximally from, the distal end portion, the compression spring comprising a first leg, a second leg, and a locating tab integral with, and extending away from, the second leg;

a common electrical terminal electrically connected to the proximal end portion of the blade spring, the common electrical terminal comprising a retainer, the retainer defining a passage; and a normally open electrical terminal comprising a contact configured to selectively electrically connect to the electrical contact of the distal end portion of the blade spring; wherein the locating tab of the compression spring extends through the passage defined by the retainer.

9. The switch assembly of claim 8, further comprising a housing including a plurality of pressure chambers.

10. The switch assembly of claim 9, further comprising a diaphragm assembly configured to at least partially define each of the plurality of pressure chambers.

11. The switch assembly of claim 10, wherein the diaphragm assembly includes a substantially rigid disk and a flexible member extending radially from the disk.

12. The switch assembly of claim 11, wherein the disk of the diaphragm assembly includes a plunger configured to engage the pressure contact region of the blade spring.

13. The switch assembly of claim 12, further comprising a biasing mechanism configured to supply a preload through the diaphragm assembly to the blade spring.

14. The switch assembly of claim 13, wherein the biasing mechanism includes a set screw and a resilient member.

15. The switch assembly of claim 14, wherein the resilient member is a coil spring.

16. The switch assembly of claim 8, further comprising a normally closed electrical terminal including a contact configured selectively to electrically connect to the electrical contact of the distal end portion of the blade spring.

17. The switch assembly of claim 16, further comprising a housing including a plurality of pressure chambers.

18. The switch assembly of claim 17, further comprising a diaphragm assembly configured to at least partially define each of the plurality of pressure chambers.

19. The switch assembly of claim 18, wherein the diaphragm assembly includes a substantially rigid disk and a flexible member extending radially from the disk.

20. The switch assembly of claim 19, wherein the disk of the diaphragm assembly includes a plunger configured to engage the pressure contact region of the blade spring.

21. The switch assembly of claim 20, further comprising a biasing mechanism configured to supply a preload through the diaphragm assembly to the blade spring.

22. The switch assembly of claim 21, wherein the biasing mechanism includes a set screw and a resilient member.

23. The switch assembly of claim 22, wherein the resilient member is a coil spring.

24. The switch assembly of claim 8, wherein:

the first leg of the compression spring is integral with the distal end portion of the blade spring and extends proximally and downwardly from the distal end portion; and the second leg of the compression spring is integral with the first leg and extends proximally from the first leg, the second leg being spaced from each of the proximal end portion and the pressure contact region.

25. The switch assembly of claim 24, wherein:

each of the first leg and the second leg of the compression spring is spaced from each of the flexible tension arms of the blade spring.

26. The switch assembly of claim 25, wherein:

the first leg and the second leg of the compression spring cooperate to define an opening, the opening configured to affect a spring constant of the compression spring.

27. A method for operating a pressure switch to signal a difference in fluid pressures, comprising:

moving a diaphragm assembly at least partially in response to a fluid pressure differential across the diaphragm assembly; and moving into an electrically conductive position with a normally open terminal an electrical contact of a blade spring, the blade spring comprising a proximal end portion configured for electrically conductive attachment to a common electrical terminal, a plurality of flexible tension arms extending from the proximal end portion, a pressure contact region configured to accept transmission of a physical force to bend at least one of the plurality of flexible tension arms, a distal end portion integral with the flexible tension arms, the distal end portion including the electrical contact, and a compression spring extending generally proximally from, and integral with, the distal end portion, the compression spring including a first leg and a second leg; wherein moving into an electrically conductive position comprises biasing the distal end portion of the blade spring away from the common electrical terminal.

28. The method of claim 27, wherein:

the common electrical terminal comprises a retainer that defines a passage;

the compression spring of the blade spring further comprises a locating tab integral with, and extending away from, the second leg; and biasing the distal end portion of the blade spring comprises inserting the locating tab of the compression spring through the passage defined by the retainer of the common electrical terminal.

29. A method comprising:

placing a diaphragm assembly within a housing, wherein the housing and the diaphragm assembly cooperate to define a high pressure chamber and a low pressure chamber separated by the diaphragm assembly, the diaphragm assembly comprising a disk and a plunger positioned generally in a center of the disk and extending downwardly from the disk within the housing;

mounting a blade spring within the housing, the blade spring comprising a proximal end portion electrically connected to a common electrical terminal, a plurality of flexible tension arms extending from the proximal end portion, a pressure contact region configured to accept transmission of a physical force to bend at least one of the plurality of flexible tension arms, a distal end portion integral with the flexible tension arms, the distal end portion including an electrical contact, and a compression spring extending generally proximally from, and integral with, the distal end portion. the compression spring including a first leg and a second leg;

positioning the pressure contact region of the blade spring below the plunger of the diaphragm assembly;

moving the diaphragm assembly at least partially in response to a fluid pressure differential across the diaphragm assembly; and moving away from an electrically conductive position with a normally open terminal the electrical contact of the blade spring; wherein moving away from an electrically conductive position comprises applying a preload through the plunger of the diaphragm assembly to the blade spring.

30. A method comprising:

placing a diaphragm assembly within a housing, wherein the housing and the diaphragm assembly cooperate to define a high pressure chamber and a low pressure chamber separated by the diaphragm assembly, the diaphragm assembly comprising a disk and a plunger positioned generally in a center of the disk and extending downwardly from the disk within the housing;

mounting a blade spring within the housing, the blade spring comprising a proximal end portion electrically connected to a common electrical terminal, a plurality of flexible tension arms extending from the proximal end portion, a pressure contact region configured to accept transmission of a physical force to bend at least one of the plurality of flexible tension arms, a distal end portion integral with the flexible tension arms, the distal end portion including an electrical contact, and a compression spring extending generally proximally from, and integral with, the distal end portion, the compression spring including a first leg and a second leg;

positioning the pressure contact region of the blade spring below the plunger of the diaphragm assembly;

moving the diaphragm assembly at least partially in response to a fluid pressure differential across the diaphragm assembly; and moving into an electrically conductive position with a normally closed terminal the electrical contact of the blade spring; wherein moving into an electrically conductive position comprises applying a preload through the plunger of the diaphragm assembly to the blade spring.

31. A method comprising:

moving a diaphragm assembly at least partially in response to a fluid pressure differential across the diaphragm assembly; and moving between an electrically conductive position with a normally open terminal and an electrically conductive position with a normally closed terminal an electrical contact of a blade spring, the blade spring including a proximal end portion configured for electrically conductive attachment to a common electrical terminal, a plurality of flexible tension arms extending from the proximal end portion, a pressure contact region configured to accept transmission of a physical force to bend at least one of the plurality of flexible tension arms, a distal end portion integral with the flexible tension arms, the distal end portion including the electrical contact, and a compression spring extending generally proximally from, and integral with, the distal end portion, the compression spring including a first leg and a second leg; wherein moving between an electrically conductive position comprises compressing a coil spring to apply a preload through the diaphragm assembly to the blade spring and biasing the distal end portion of the blade spring away from the common electrical terminal.

32. The method of claim 31, wherein:

the common electrical terminal comprises a retainer that defines a passage;

the compression spring of the blade spring further comprises a locating tab integral with, and extending away from, the second leg; and biasing the distal end portion of the blade spring comprises inserting the locating tab of the compression spring through the passage defined by the retainer of the common electrical terminal.

33. A method comprising:

placing a diaphragm assembly within a housing, wherein the housing and the diaphragm assembly cooperate to define a high pressure chamber and a low pressure chamber separated by the diaphragm assembly;

mounting a blade spring within the housing, wherein the blade spring comprises a proximal end portion, a distal end portion having an electrical contact and a compression spring integral with, and extending generally proximally from, the distal end portion, the compression spring comprising a first leg, a second leg and a locating tab integral with, and extending away from, the second leg; and electrically connecting the blade spring to a second terminal when a difference in fluid pressure between the high pressure chamber and the low pressure chamber is at least equal to a predetermined value; wherein mounting comprises fixing the proximal end portion of the blade spring to a first terminal and inserting the locating tab of the compression spring of the blade spring through a passage defined by a retainer of the first terminal.

* * * * *

UNITED STATES PATENT AND TRADEMARK OFFICE

CERTIFICATE OF CORRECTION

PATENT NO. : 8,362,375 B2
APPLICATION NO. : 12/522879
DATED : January 29, 2013
INVENTOR(S) : Craig R. Wildman It is certified that error appears in the above-identified patent and that said Letters Patent is hereby corrected as shown below:

In the Specification

Column 2, lines 36-67, delete: "A method for constructing a blade spring comprises forming an elongated piece of flexible electrically conductive spring material and forming a plurality of tension arms from the elongated piece. The method further includes integrally forming a compression portion from the elongated piece.

A blade spring for switching an electrical circuit comprises a proximal end portion, a plurality of flexible tension arms, means for accepting transmission of a physical force to bend at least one of the plurality of flexible tension arms, a distal end portion, and means for applying tension to the flexible tension arms integral with the distal end portion. The proximal end portion is configured for electrically conductive attachment to an electrical terminal. The plurality of flexible tension arms extend from the proximal end portion. The distal end portion is integral with the flexible tension arms and includes an electrical contact.

A method for signaling differences in fluid pressure comprises moving a diaphragm assembly at least partially in response to a fluid pressure differential across the diaphragm assembly. The method also includes moving into an electrically conductive position with a normally open terminal an electrical contact carried by a blade spring. The blade spring includes a proximal end portion, a plurality of flexible tension arms, a pressure contact region, a distal end portion, and an integral compression spring. The proximal end portion is configured for electrically conductive attachment to an electrical terminal. The plurality of flexible tension arms extend from the proximal end portion. The pressure contact region is configured to accept transmission of a physical force to bend at least one of the plurality of flexible tension arms. The distal end portion is integral with the flexible tension arms and includes the electrical contact. The compression spring"

Column 3, lines 1-3, delete: "extends generally proximally from, and integral with, the distal end portion. The compression spring includes a first leg and a second leg."

Column 12, line 59, replace: "a the" with -- the --;

In the Claims

Column 14, claim 2, line 65, replace: "nor" with -- for --; and

Column 15, claim 16, line 61, replace: "selectively to" with -- to selectively --.

Signed and Sealed this
Eighteenth Day of February, 2014

Michelle K. Lee

Michelle K. Lee
*Deputy Director of the United States Patent and Trademark Office*